US009401544B2

(12) United States Patent
Zhang

(10) Patent No.: US 9,401,544 B2
(45) Date of Patent: Jul. 26, 2016

(54) QUAD-BAND INTERNAL ANTENNA AND MOBILE COMMUNICATION TERMINAL THEREOF

(75) Inventor: Lian Zhang, Guangdong (CN)

(73) Assignee: HUIZHOU TCL MOBILE COMMUNICATION CO., LTD., Huizhou, Guangdong (CN)

( * ) Notice: Subject to any disclaimer, the term of this patent is extended or adjusted under 35 U.S.C. 154(b) by 326 days.

(21) Appl. No.: 13/816,214

(22) PCT Filed: Nov. 4, 2011

(86) PCT No.: PCT/CN2011/081780
§ 371 (c)(1),
(2), (4) Date: Feb. 8, 2013

(87) PCT Pub. No.: WO2012/071966
PCT Pub. Date: Jun. 7, 2012

(65) Prior Publication Data

US 2013/0135155 A1 May 30, 2013

(30) Foreign Application Priority Data

Dec. 1, 2010 (CN) ..... 2010 1 0568426

(51) Int. Cl.

| | |
|---|---|
| ***H01Q 1/24*** | (2006.01) |
| ***H01Q 9/04*** | (2006.01) |
| ***H01Q 1/48*** | (2006.01) |
| ***H01Q 3/26*** | (2006.01) |

(Continued)

(52) U.S. Cl.
CPC ..... *H01Q 9/04* (2013.01); *H01Q 1/243* (2013.01); *H01Q 1/245* (2013.01); *H01Q 1/48* (2013.01); *H01Q 3/26* (2013.01); *H01Q 5/364* (2015.01); *H01Q 5/385* (2015.01); *H01Q 9/0421* (2013.01)

(58) Field of Classification Search
CPC ... H01Q 1/243; H01Q 5/0065; H01Q 9/0421; H01Q 5/0055
USPC ..... 343/700 MS, 702, 767, 725, 770
See application file for complete search history.

(56) References Cited

U.S. PATENT DOCUMENTS

| | | | | |
|---|---|---|---|---|
| 6,043,786 | A * | 3/2000 | Vannatta et al. | 343/770 |
| 6,140,966 | A * | 10/2000 | Pankinaho | 343/700 MS |
| 6,646,606 | B2 * | 11/2003 | Mikkola | H01Q 1/243 343/700 MS |

(Continued)

FOREIGN PATENT DOCUMENTS

| | | | |
|---|---|---|---|
| CN | 1495966 | A | 5/2004 |
| WO | 2006097496 | A1 | 9/2006 |
| WO | 2006114477 | A1 | 11/2006 |

OTHER PUBLICATIONS

Lin, C.-I. and Wong, K.-L., Internal hybrid antenna for multiband operation in the mobile phone. Microwave and Optical Technology Letters., Jan. 31, 2008, p. 38-42, vol. 50, issue 1.

(Continued)

*Primary Examiner* — Michael C Wimer
(74) *Attorney, Agent, or Firm* — Shimokaji IP

(57) ABSTRACT

A quad-band internal antenna may include an antenna radiating element, a first slotted hole and a second slotted hole arranged on a printed circuit board. The first slotted hole may be arranged along a direction perpendicular to the current flow direction of the printed circuit board, and the second slotted hole may be arranged between a ground pin and a feed pin of the antenna radiating element, such that the first slotted hole and the second slotted hole are both open slotted holes.

16 Claims, 4 Drawing Sheets

(51) Int. Cl.
*H01Q 5/364* (2015.01)
*H01Q 5/385* (2015.01)

(56) References Cited

U.S. PATENT DOCUMENTS 6,864,848 B2 * 3/2005 Sievenpiper ..... 343/767
6,985,108 B2 * 1/2006 Mikkola et al. ..... 343/700 MS
7,256,743 B2 * 8/2007 Korva ..... H01Q 1/244 343/702

OTHER PUBLICATIONS

Chinese Office Action in CN Application No. 201010568426.9 dated Feb. 8, 2013.

* cited by examiner

QUAD-BAND INTERNAL ANTENNA AND MOBILE COMMUNICATION TERMINAL THEREOF

TECHNICAL FIELD

The present invention relates to the field of broadband antennas of wireless communication devices, and in particular, to a quad-band internal antenna and a mobile communication terminal thereof.

BACKGROUND

Along with the miniaturization development trend of mobile communication transmit-receive terminals, especially the miniaturization of mobile phones, there may exist a need for smaller and smaller antennas. In the field of mobile phones, a drawback of an initial external antenna, which is a very short device extruding from a housing, is that such external antenna is a sensitive mechanical structure and easy to break off. So from the aspect of design, an antenna may be hidden or integrated within the housing of a communication device. Such internal antenna or integrated antenna may need to cover the total bandwidth of various radio channels in its own position.

At present, multi-system communication standards may require an integrated antenna to cover a frequency range from, for example, 824 MHz to 2170 MHz. A problem may exist particularly with a handheld mobile communication terminal, that is, resonance deviation of various degrees may be caused during a conversation to the antenna because the handheld mobile communication terminal goes through different positions when it is held by a user. While such resonance frequency deviation may have to be compensated by bandwidth, the bandwidth of the antenna may have to be wider than the necessary frequency band to compensate for a loss brought by resonance frequency deviation. But in the prior art, usually only with large physical dimensions can the broadband antenna compensate for the loss brought by resonance frequency deviation. However this may go against the development trend of miniaturizing mobile communication terminals.

Therefore, the prior art needs to be improved and developed.

SUMMARY OF THE INVENTION

An aspect of the present invention may be to provide a quad-band internal antenna and a mobile communication terminal to achieve relatively large bandwidth characteristics within a finite space to meet the development demand of miniaturizing the mobile communication terminals.

The present invention may include a quad-band internal antenna, wherein, it comprises an antenna radiating element and a first slotted hole and a second slotted hole arranged on a printed circuit board. The first slotted hole may be arranged along a direction substantially perpendicular to the current flow direction of the printed circuit board. The second slotted hole may be arranged between a ground pin and a feed pin of the antenna radiating element. Both the first slotted hole and the second slotted hole may be open slotted holes.

A quad-band internal antenna may include a printed circuit board substantially in the shape of a rectangle. A line connecting the ground pin and the feed pin of the antenna radiating element may be set along a long side of the substantially rectangular shape. The first slotted hole may be set along a short side of the substantially rectangular shape.

The quad-band internal antenna may include a second slotted hole that may be set along a short side of the substantially rectangular shape.

The quad-band internal antenna may include an open end of the first slotted hole that may be set on a long side of the substantially rectangular shape on which the ground pin and the feed pin of antenna radiating element may be located.

The quad-band internal antenna may include an open end of the second slotted hole that may be set on the same long side of the substantially rectangular shape as that of the first slotted hole.

The quad-band internal antenna may include a length of the first slotted hole that is less than that of the substantially rectangular shape's short sides.

The quad-band internal antenna may include a length of the second slotted hole that is less than that of the first slotted hole.

The quad-band internal antenna may include an antenna radiating element with a low-frequency branch section. The first slotted hole may overlap with a projection area section of the low-frequency branch section projected on the printed circuit board.

The quad-band internal antenna may include the antenna radiating element with a high-frequency branch section. The second slotted hole may overlap with the projection area section of the high-frequency branch section projected on the printed circuit board.

A mobile communication terminal may include a housing and a printed circuit board with an internal antenna arranged in the housing. The internal antenna may include an antenna radiating element, a first slotted hole and a second slotted hole arranged on the printed circuit board. The first slotted hole may be arranged along a direction that may be substantially perpendicular to the current flow direction of the printed circuit board. The second slotted hole may be arranged between a ground pin and a feed pin of the antenna radiating element. Both the first slotted hole and the second slotted hole may be open slotted holes.

The quad-band internal antenna and the mobile communication terminal may include slotted holes (including the first slotted hole and the second slotted hole) on the printed circuit board to adjust its low-frequency resonance model to be close to the center frequency of an antenna low-frequency branch section. The printed circuit board may resonate through the antenna, and the bandwidth of the antenna may consequently expand in a low-frequency band. At the same time, by exciting the first slotted hole to self-resonate at a quarter-wavelength and by serving as a spurious resonance unit of high-frequency, the bandwidth of the antenna in a high-frequency band may be expanded. Moreover, the second slotted hole located between the ground pin and the feed pin of the antenna, may match and fine tune input impedance for both low and high frequencies to further expand the bandwidth of the high-frequency band. As a consequence, a frequency deviation caused by the terminal being held in a user's hand may be compensated for and the characteristics of the mobile communication terminal may be optimized when it is in a handheld model. As a result relatively large bandwidth characteristics may be achieved and accordingly the development requirement for miniaturizing the mobile communication terminals may be satisfied.

DETAILED DESCRIPTION OF THE INVENTION

The specific implementation methods and embodiments of the present invention may be further described in detail below with reference to the accompanying drawings. It should be understood that the embodiments described herein are only used for describing the present invention with no intention to limit the specific implementation methods of the present invention in any way.

Figure 1:
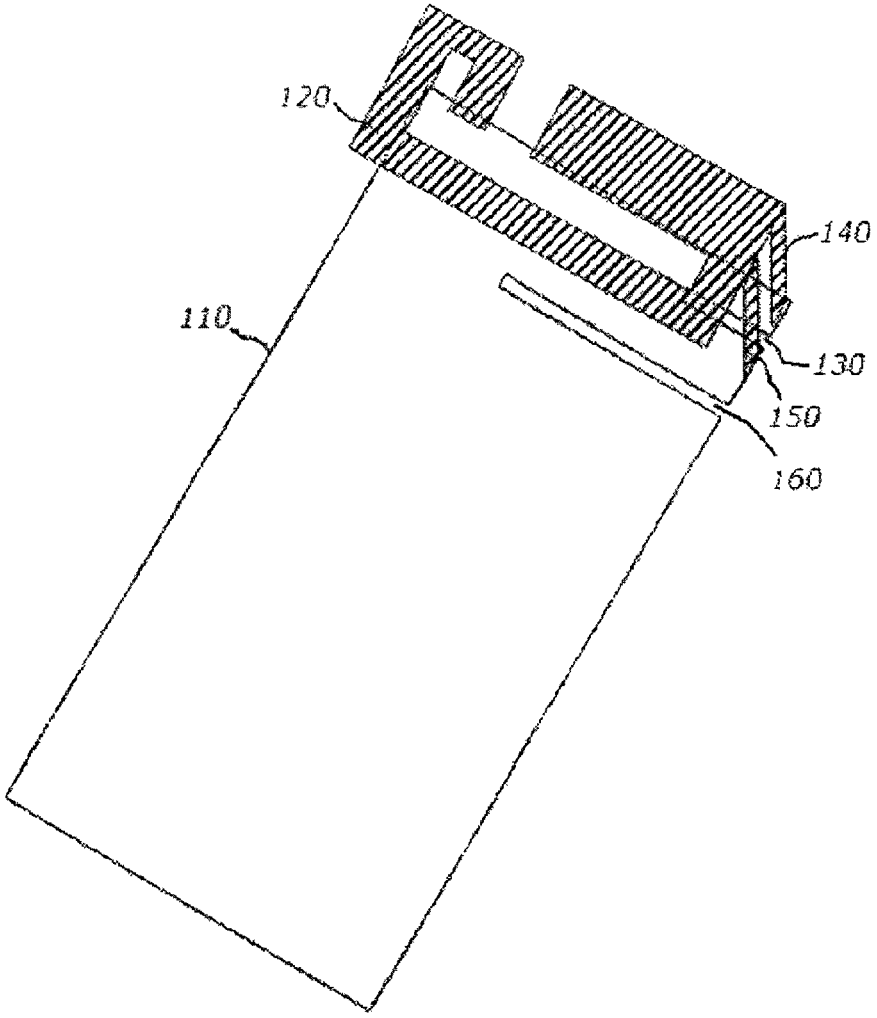
FIG. 1 is an exploded structural schematic diagram of a quad-band internal antenna according to an embodiment of the present invention.

In an exemplary embodiment, a quad-band internal antenna as shown in FIG. 1, may include an antenna radiating element 120, a first slotted hole 160 and a second slotted hole 130 distributed on a printed circuit board 110. The first slotted hole 160 may be arranged along a direction perpendicular to the current flow direction of the printed circuit board 110. The second slotted hole 130 may be arranged between a ground pin 140 and a feed pin 150 of the antenna radiating element 120. Both the first slotted hole 160 and the second slotted hole 130 may be open slotted holes.

Based on the above mentioned quad-band internal antenna, the present invention may further include a mobile communication terminal, with a housing and a printed circuit board 110, and an internal antenna arranged in the housing. The internal antenna may include an antenna radiating element 120, a first slotted hole 160 and a second slotted hole 130 arranged on the printed circuit board 110. The first slotted hole 160 may be arranged along a direction substantially perpendicular to the current flow direction of the printed circuit board 110. The second slotted hole 130 may be arranged between a ground pin 140 and a feed pin 150 of an antenna radiating element 120. Both the first slotted hole 160 and the second slotted hole 130 may be open slotted holes.

The quad-band internal antenna and the mobile communication terminal, having slotted holes (including the first slotted hole 160 and the second slotted hole 130) on the printed circuit board 110 may adjust its low-frequency resonance model to be close to the center frequency of an antenna low-frequency branch section, causing the printed circuit board 110 to resonate through the antenna. The bandwidth of the antenna may therefore expand in a low-frequency band. At the same time, by exciting the first slotted hole 160 to self-resonate at quarter-wavelength and serving as a spurious resonance unit of high-frequency, the bandwidth of the antenna in a high-frequency band may be expanded. Moreover, the second slotted hole 130 located between ground pin 140 and feed pin 150 of the antenna may cause the matching and fine tuning of the input impedance at low and high frequencies to further expand the bandwidth at high-frequencies so as to compensate for a frequency deviation caused by the terminal being held in a user's hand. The characteristics of the mobile communication terminal may be optimized when it is a handheld model. As a result, relatively large bandwidth characteristics may be achieved and accordingly the development requirement for miniaturizing the mobile communication terminals may be satisfied.

Taking a planar inverted-F antenna as the antenna radiating element 120 for example, in an embodiment of a quad-band internal antenna and a mobile communication terminal, as shown in FIG. 1, there may be two branch sections of the terminal's open circuit on the antenna radiating element 120. The working principle may be about a quarter-wavelength resonance. The outside part, which may be wider and shorter than the inside part, may be the high-frequency branch section. The inside part, which may be narrower and longer than the outside part, may be the low-frequency branch section. Because there may be a size limitation on the antenna radiating element 120, the self-resonant bandwidth may be unable to meet the requirements on the radio channels for multiple communication systems, especially in a low-frequency band. Under such situations, the antenna radiating element 120 can be used as an exciting element to excite the printed circuit board 110 and take advantage of the larger size of the printed circuit board 110 to make it become a resonance model of the low-frequency band.

Figure 2:
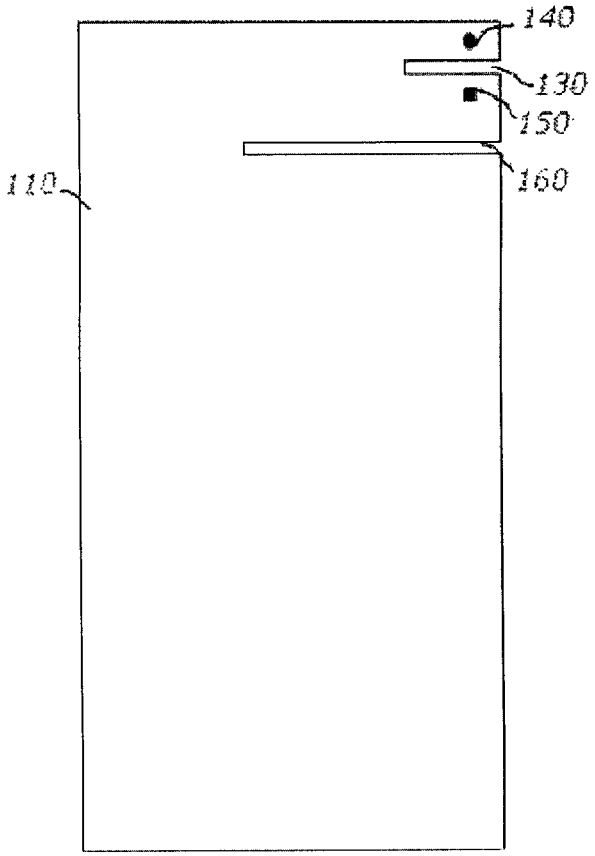
FIG. 2 is a plane structure schematic diagram of a quad-band internal antenna according to an embodiment of the present invention on a PCB section.

As shown in FIG. 2, the shape of printed circuit board 110 can be a longitudinal substantially rectangular shape. The line connecting the ground pin 140 and feed pin 150 of the antenna radiating element 120 may be set along a long side of the substantially rectangular shape. The first slotted hole 160 may be set along a short side of the substantially rectangular shape.

Because the longitudinal current of printed circuit board 110, which flows along the length direction of the substantially rectangular shape, and usually has higher radiation efficiency, the radiation performance in a low-frequency band may be mainly determined by the longitudinal current of the printed circuit board 110. Therefore, changing the resonance frequency of the longitudinal current of the printed circuit board 110 to make it closer to the center frequency of a low-frequency band, can in one aspect increase radiation efficiency, and in another aspect expand the bandwidth at the low-frequency band.

Specifically, the first slotted hole 160 may be added in a manner substantially perpendicular to the longitudinal current to change the direction of the current and compel the current to pass through the first slotted hole 160, which may extend the longitudinal current length. For example, the first slotted hole 160 may be substantially parallel to the width of the printed circuit board 110 without completely cutting the printed circuit board 110 off. The first slotted hole 160, which may be excited by the low-frequency branch section of the antenna radiating element 120, together with the self-resonance of the antenna radiating element 120, may be equivalent to a parallel connection of two resonance circuits. The bandwidth can cover the frequency bands of GSM850 and GSM900. GSM herein means global system for mobile communications.

Further, as shown in FIG. 2, the open end of the first slotted hole 160 may be set on a long side of the substantially rectangular shape on which the ground pin 140 and the feed pin 150 of the antenna radiating element 120 are located. The length of the first slotted hole 160 may be set to be not longer than the length of a short side of the substantially rectangular shape.

Specifically, the length of the first slotted hole 160 can be designed as close to a quarter-wavelength of a high-frequency band, with a short-circuit and an open-circuit, to make the resonance frequency at about a quarter-wavelength within the operating frequency band of the high-frequency band. The resonance generated thereby can help expand the bandwidth at the high-frequency band so that the bandwidth can cover frequency bands of DCS 1800 (Digital Cellular System at 1800 MHz) and PCS (Personal Communications System operating in the 1900 MHz band).

Figure 3:
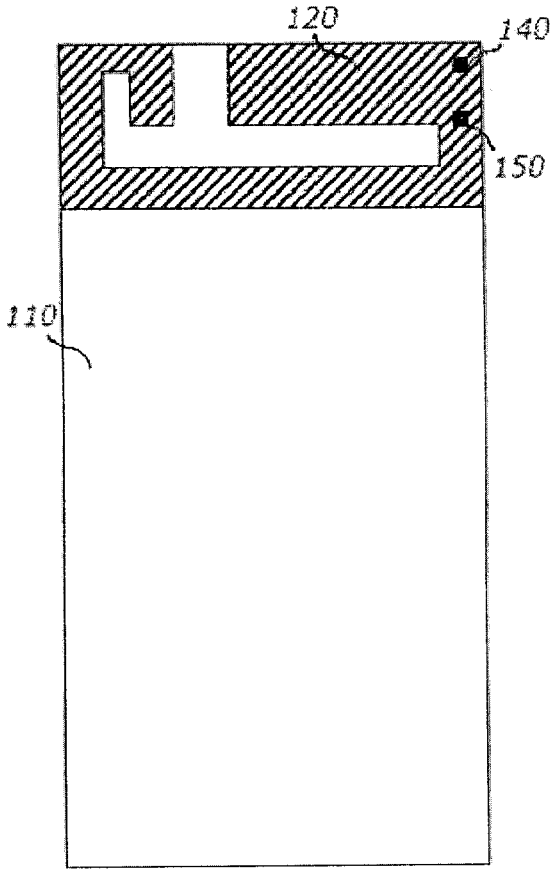
FIG. 3 is a top view of a quad-band internal antenna according to an embodiment of the present invention.

Further, as shown in FIG. 3, the first slotted hole 160 may overlap with the low-frequency branch section of the antenna radiating element 120 in the height direction to achieve capacitance coupling with the antenna radiating element 120 effectively. That is to say, the position of the first slotted 160 on the printed circuit board 110 can overlap with the projection area section of the low-frequency branch section projected on the printed circuit board 110, and also can be located within the projection area of the low-frequency branch section of the antenna radiating element 120 projected on the printed circuit board 110.

As shown in FIG. 2, the second slotted hole 130 can also be set along a short side of the substantially rectangular shape. The open end of the second slotted hole 130 and the open end of the first slotted hole 160 can be arranged on the same long side of the substantially rectangular shape. The length of the second slotted hole 130 may be less than that of the first slotted hole 160.

Further, as shown in FIG. 3, the second slotted hole 130 can overlap with the high-frequency branch section of the antenna radiating element 120 in the height direction for the purpose of capacitance coupling with the antenna radiating element 120 effectively. That is to say, the position of the second slotted hole 130 on the printed circuit board 110 can overlap with the projection area section of the high-frequency branch section projected on the printed circuit board 110, and also can be located within the projection area of the high-frequency branch section of the antenna radiating element 120 projected on the printed circuit board 110.

The second slotted hole 130 may be set in the space between ground pin 140 of the antenna radiating element 120 and the feed pin 150 of the antenna radiating element 120 to conduct input impedance matching. Properly adjusting the length of the second slotted hole 130 can fine tune the input impedance of low and high frequencies. The matching and fine tuning to the input impedance of high frequency band can further expand the bandwidth of the high-frequency band to compensate for a frequency deviation caused by the terminal being held in a hand and to optimize the characteristics of the mobile communication terminal when it is in a handheld model.

The quad-band internal antenna of the present invention can improve an antenna's bandwidth by the following means: by adding the first slotted hole 160 to change the resonance model of the printed circuit board 110 to make it closer to the center frequency of low-frequency band. Then the bandwidth of the antenna for a low-frequency band may be expanded, and may cause the first slotted hole 160 to self-resonate at about a quarter-wavelength and serve as spurious resonance of a high-frequency band so as to improve the bandwidth of the antenna in a high-frequency band. In addition, the quad-band internal antenna may set the second slotted hole 130 between the ground pin and the feed pin of the planner inverted-F antenna to further adjust the input impedance matching of low and high frequencies, especially the low frequencies.

In an exemplary embodiment, bandwidth performance of the antenna at a low-frequency may be determined by the dimensions of the printed circuit board 110, especially the length. Because the internal antenna is smaller, the bandwidth for the self-resonance may be far from meeting the requirements of channels for communication systems. However, the frequency of the printed circuit board 110 when it is in resonance may be much closer to the center frequency of the antenna in a low-frequency band and the bandwidth generated thereby may be greater than the self-resonance bandwidth of the internal antenna.

Therefore, effectively exciting the printed circuit board 110 to self-resonate may be an effective way to expand the antenna's bandwidth at low-frequency. Therefore, the first slotted hole 160 may be set along a direction perpendicular to current flow direction of the printed circuit board 110 to extend the current path so as to reduce the resonance frequency of the printed circuit board 110 and make it closer to the center frequency of a low-frequency band. As a result, the bandwidth range of the internal antenna in a low-frequency band may be improved.

In an exemplary embodiment, the first slotted hole 160 on the printed circuit board 110 can be equivalent to a quarter-wavelength slot antenna in a high-frequency band serving as a spurious unit of a high-frequency band of the internal antenna. The resonance generated thereby can improve the bandwidth of the antenna in a high-frequency band.

Therefore, in a limited space, the antenna of the mobile communication terminal may improve the bandwidth of the internal antenna in a low-frequency band and in a high-frequency band and may make the bandwidth of the antenna cover the frequency bands of GSM850, EGSM900, DCS and PCS by the use of slotted holes on the printed circuit board 110. The expanded bandwidth can compensate for the frequency deviation caused by a hand held state, and accordingly may optimize the performance of the mobile communication terminal in the handheld situation.

Figure 4:
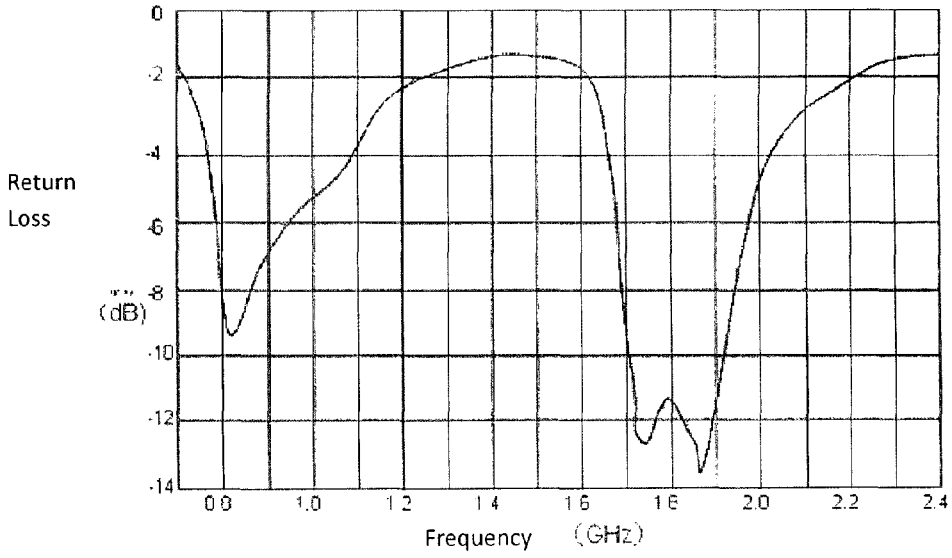
FIG. 4 is a curve graph of return loss test of a quad-band internal antenna according to an embodiment of the present invention.

Also the results of the test may indicate that, as shown in FIG. 4, seen from the curve of return loss test, the quad-band internal antenna of the present invention indeed may have enough bandwidth to satisfy the demands of the GSM850, EGSM900, DCS and PCS frequency bands.

It should be understood that the description above are embodiments of the present invention with no intention to limit the technical solutions of the present invention. For those skilled in this field, additions and reductions, replacements, variations and improvements can be made according to the above mentioned description without departing from the spirit and scope of the invention. For example, the antenna radiating element 120 may include, but not be limited to, a planar inverted-F antenna, equivalent replacements of a horizontal substantially rectangular shape, longitudinal substantially rectangular shape, and so on, while all these technical solutions with any addition or reduction, replacement, variation or improvement may be encompassed in the scope defined by the claims attached to the present invention.

The invention claimed is:

1. A quad-band internal antenna, comprising:

an antenna radiating element having a low-frequency branch section and a high frequency branch section separated from the low-frequency branch section by a T-shaped slot, the high frequency branch section being wider and shorter than the low-frequency branch section, and the high frequency branch is further separated into two parts by the T-shaped slot;

a first slotted hole on a printed circuit board, wherein the first slotted hole overlaps with the low-frequency branch section of the antenna radiating element in a height direction and has a length close to a quarter-wavelength of a high frequency band;

a second slotted hole arranged on the printed circuit board, wherein the second slotted hole overlaps with the high frequency branch section of the antenna radiating element in the height direction and has a length shorter than the length of the first slotted hole, wherein the first slotted hole is arranged along a direction substantially perpendicular to a current flow direction within the printed circuit board, wherein the second slotted hole is arranged between a ground pin and a feed pin of the antenna radiating element, and wherein both the first slotted hole and the second slotted hole are open slotted holes with an open end.

2. The quad-band internal antenna of claim 1, wherein the printed circuit board is substantially of rectangular shape;

wherein a line connecting the ground pin and the feed pin of the antenna radiating element is set along a long side of the substantially rectangular shape;

wherein the first slotted hole is arranged along a short side of the substantially rectangular shape.

3. The quad-band internal antenna of claim 2, wherein the second slotted hole is arranged along the short side of the substantially rectangular shape.

4. The quad-band internal antenna of claim 2, wherein the open end of the first slotted hole is set on the long side of the substantially rectangular shape on which the ground pin and feed pin of the antenna radiating element are located.

5. The quad-band internal antenna of claim 4, wherein the open end of the second slotted hole and the open end of the first slotted hole are set on the same long side of the substantially rectangular shape.

6. The quad-band internal antenna of claim 2, wherein the length of the first slotted hole is less than that of the substantially rectangular shape's short side.

7. The quad-band internal antenna of claim 1, wherein the length of the second slotted hole is less than the length of the first slotted hole.

8. The quad-band internal antenna of claim 1, wherein the first slotted hole self-resonates at about a quarter-wavelength of an input frequency.

9. The quad-band internal antenna of claim 1, wherein the first slotted hole is substantially parallel with a width direction of the printed circuit board.

10. A mobile communication terminal, comprising:

a housing;

a printed circuit board; and an internal antenna arranged in the housing, wherein the internal antenna comprises an antenna radiating element having a low-frequency branch section of a first shape and a high frequency branch section of a different shape, a first slotted hole and a second slotted hole arranged on the printed circuit board, wherein the first slotted hole is arranged along a direction that is substantially perpendicular to a current flow direction within the printed circuit board, and the first slotted hole overlaps with the low-frequency branch section of the antenna radiating element in a height direction and has a length close to a quarter-wavelength of a high frequency band, wherein the second slotted hole is arranged between a ground pin and a feed pin of the antenna radiating element, the second slotted hole overlaps with the high frequency branch section of the antenna radiating element in the height direction and has a length shorter than the length of the first slotted hole, the feed pin overlaps with the low-frequency branch section of the antenna radiating element in the height direction, and the ground pin overlaps with the high-frequency branch section of the antenna radiating element in the height direction, and wherein both the first slotted hole and the second slotted hole are open slotted holes with an open end, and wherein the first slotted hole and the second slotted hole adjust a low-frequency resonance model to a center frequency of an antenna low-frequency branch section such that a self-resonance bandwidth of the printed circuit board is greater than a self-resonance bandwidth of the antenna radiating element.

11. The mobile communication terminal of claim 10, wherein the first slotted hole self-resonates at about a quarter-wavelength of an input frequency.

12. The mobile communication terminal of claim 10, wherein the first slotted hole is substantially parallel with a width direction of the printed circuit board.

13. The mobile communication terminal of claim 10, wherein the open end of the first slotted hole is set on a long side of the printed circuit board on which the ground pin and the feed pin of the antenna radiating element are located.

14. The mobile communication terminal of claim 10, wherein the open end of the second slotted hole and the open end of the first slotted hole are set on the same long side of the printed circuit board.

15. The mobile communication terminal of claim 10, wherein the length of the first slotted hole is less than that of a short side of the printed circuit board.

16. The mobile communication terminal of claim 10, wherein the length of the second slotted hole is less than that of the first slotted hole.

* * * * *